US005887368A

United States Patent [19]

Rupp

[11] Patent Number: 5,887,368

[45] Date of Patent: Mar. 30, 1999

[54] CABLE TAG HAVING SEPARABLE SUB-LABEL AND METHOD OF USING SAME

[75] Inventor: Diana A. Rupp, Cary, N.C.

[73] Assignee: Northern Telecom Limited, Montreal, Canada

[21] Appl. No.: 953,652

[22] Filed: Oct. 17, 1997

[51] Int. Cl.[6] ..... G09F 19/00

[52] U.S. Cl. ..... 40/316; 40/630; 40/674

[58] Field of Search ..... 40/316, 630, 638, 40/674

[56] References Cited

U.S. PATENT DOCUMENTS

| | | | |
|---|---|---|---|
| 3,921,319 | 11/1975 | Styers et al. | 40/654 |
| 4,763,930 | 8/1988 | Matney | 40/310 |
| 5,225,162 | 7/1993 | Scoville | 40/674 |

FOREIGN PATENT DOCUMENTS

| | | | |
|---|---|---|---|
| 582242 | 2/1994 | European Pat. Off. | 40/102 |

*Primary Examiner*—Cassandra H. Davis

*Attorney, Agent, or Firm*—Finnegan, Henderson, Farabow, Garrett & Dunner, L.L.P.

[57] ABSTRACT

A cable tag allows information about the identity of a communications or power cable and its route to be secured to the cable. The cable tag is secured to a cable in such a way that it can be readily removed and re-secured if necessary. For installation, a portion of a liner adhered to a face stock of the cable tag is removed to expose adhesive. Folding the tag around the cable causes the areas of exposed adhesive to come into contact with each other and with the cable. The remaining portion of the liner on the back of the face stock provides a non-adherent surface where a user's fingers can easily separate the cable tag from the cable. The cable tag includes removable sub-labels to permanently fix originating and terminating information to the cable after installation. The remaining part of the cable tag may then be removed and discarded if necessary.

14 Claims, 5 Drawing Sheets

CABLE TAG HAVING SEPARABLE SUB-LABEL AND METHOD OF USING SAME

BACKGROUND OF THE INVENTION

In general, the present invention relates to tags and labels for conveying identifying information about an object to which the tag or label is adhered and a method for using such tags or labels. More particularly, the present invention relates to tags and labels adhered to communications and power cables used to connect various aspects of, for example, communications hardware, which tags and labels provide important information about the cables and their connectors. The present invention also relates to a method for using such tags and labels on cables.

Frame-to-frame cables are typically used to connect all aspects of large computers and telecommunications systems. Such cables may connect the backplane of one frame of a computer to the backplane of another computer to carry, for example, voice or data information. Such cables are also used to provide power to computers, as well as connect them to ground. In the typical communications site, many computer frames are interconnected. As a result, many frame-to-frame cables are required. Such cables are often routed in large numbers throughout internal and external facilities and throughout buildings. Within buildings, communications and power cables like frame-to-frame cables are often routed under floors or above ceilings in cable troughs.

Given the various applications, locations, and pathways which these cables travel, installers and maintenance workers require information about the cables. For example, installers must know the originating and terminating location for the cable and the path by which the cable should be routed to connect those two locations. Installers must also know the type of connector to be used for a particular cable. Among other information, installers need to know the purchase order associated with a cable, the job number associated with the cable, and whether the connector should be shielded against electromagnetic interference.

Because such information is usually unique to a particular cable, in conventional techniques, temporary cable tags containing such information have been placed on both ends of a cable by fabricators. Cables arrive at an installation site with tags applied to both ends containing this vital information. In some cases, however, the proper length of a particular cable cannot be accurately determined in advance of installation. For example, the fabricators may not be able to determine from the blueprints of a site the exact distance between an originating location on one floor and a terminating location on another floor. As a result, the cable for these applications cannot be precut or fitted with connectors in advance. Instead, these cables must be cut and have their connectors attached at the job site.

In these situations, spools of the correct cable type with packages of cable tags are sent to the site. The installer makes a safe estimate of the length required for the cable and then cuts the cable from the spool. The cable tags are then placed on both ends of the cut cable for identification in the cable routing process. The cable tags, however, must be repositionable. Because the installers must estimate the length of the cable, the installers will likely have to further adjust the length of the cable to better fit the project. As the cable is shortened, the installer must remove the tag and move it back along the cable. In fact, installers may have to make several adjustments to the cable length, requiring them to move the temporary tags several times.

To allow for repositioning, conventional temporary tags have used a weak adhesive, such as Technicote TR455 acrylic removable adhesive. Each end is also folded over to form a tab to allow the user to pull the two halves apart. Due to the weak adhesive, these tags, while repositionable, have been known to fall off during routing. Moreover, tags applied by fabricators use the same weak adhesive. Those tags, as a result, have also been known to fall off during shipping to the installation site or after the passage of time.

However, cable tags, regardless of where they are applied, must be resistant to removal. During the routing process the cables are often dragged through long lengths of cable troughs, under floors, and along walls between floors. Accordingly, the cable tags must resist tearing, stretching, and abrasion while remaining stationary on the cable throughout the process. If a tag falls off while the cable is being pulled between floors, the installer will not know the terminating location for that cable. He or she must then trace that cable back to its originating location to determine its terminating location. Accordingly, lost cable tags cause substantial delays in installation.

Most of the information on conventional tags for communications or power cables applied by fabricators or during installation is not necessary for maintenance. Troubleshooters do not need to know the original purchase order for a cable or the installation job number, for example. Furthermore, tags used to relay installation information are typically large, and many cables are often routed together. Large tags, accordingly, cause unsatisfactory clutter. Moreover, the collection of a large number of tags presents a fire hazard. Therefore, workers have had to remove large tags after installation. Previously, maintenance of the cables then proceeded on a trial and error basis due to the loss of identifying information previously available on the tags. Cables would then have to be checked one at a time, connection by connection, to find the problem cable. This process is time-consuming and highly inefficient.

Accordingly, customers now require that the originating and terminating information remain on the cables for the life of the cables to assist in maintenance and troubleshooting. To satisfy this customer requirement, installers have been copying by hand the originating and terminating information from the current large tag to a small "flag tag." The small flag tag with originating and terminating information is then permanently adhered to the cable both at the originating and terminating location. This process, however, is also time-consuming and subject to human error.

In light of the foregoing, there is a need for a cable tag that at least identifies the routing information for a communications or power cable, overcomes the problem of falling off after multiple repositionings, provides permanent labeling information for the cable, and does not pose a fire hazard.

SUMMARY OF THE INVENTION

Accordingly, the present invention is directed to a cable tag that substantially obviates one or more of the limitations and disadvantages of the related art.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve these and other objects and advantages, and in accordance with the purpose of the invention as embodied and broadly described herein, a tag consistent with the present invention for indicating identifying and routing information on a cable includes a face stock having a first surface area containing identification and routing information about the cable and including a first separable sub-label within a portion of said first surface area. The first separable sub-label has an opaque surface area containing the identification and routing information and a transparent surface area. The tag further includes an adhesive affixed to a back side of said face stock opposite said first surface area, and a liner removably affixed to said adhesive having a die-cut portion to form a separable section. The die-cut portion is symmetrical about a folding axis of the tag.

In a second aspect, an apparatus consistent with the present invention for routing electromagnetic signals between at least two locations includes a cable and at least one label having a length longer than a circumference of the cable. The at least one label is adhered to the cable and wrapped at least partially around the cable such that at least portions of the label not contacting the cable contact each other. The label includes a face stock having a first surface area containing identification and routing information about the cable and includes a first separable sub-label within a portion of the first surface area. The first separable sub-label has an opaque surface area containing the identification and routing information and a transparent surface area. An adhesive is affixed to a back side of the face stock opposite the first surface area, and a liner is affixed to the adhesive on the back side in all regions other than the at least portions of the label contacting each other.

In another aspect, a method consistent with the present invention for labeling an electromagnetic transmission cable with identifying and routing information includes the steps of removing a strip of liner material from a back side of a cable tag to expose a surface area of adhesive, where the cable tag includes face stock on a front side; folding the cable tag about a horizontal axis defined by the cable to bring portions of the exposed surface area of adhesive into contact and to removably attach the cable tag to the cable along a remaining portion of the exposed surface area of adhesive, where the cable tag includes identification and routing information for the cable; installing the cable in a facility; removing a sub-label from the cable tag having an opaque surface area also containing the identification and routing information for the cable; and permanently affixing the sub-label to the cable by wrapping the sub-label about the cable.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification, illustrate an embodiment of the invention and, together with the description, serve to explain the objects, advantages and principles of the invention.

DETAILED DESCRIPTION OF THE PREFERRED EMBODIMENTS

Reference will now be made in detail to the present preferred embodiment of the invention, an example of which is illustrated in the accompanying drawings. Wherever possible, the same reference numbers will be used throughout the drawings to refer to the same or like parts.

The present invention provides a cable tag for a communications or power cable that can be readily repositioned yet will reliably remain in place during installation. These advantages can preferably be achieved by using a stronger adhesive on the back of a face stock of the cable tag while simultaneously using less area for adhering the cable tag to the cable. In a preferred embodiment, two narrow strips of liner are removed along the back sides of the cable tag to expose two corresponding areas of adhesive on the back of the face stock. When the cable tag is folded about the cable only strips of exposed adhesive contact each other. Liner remains along the back middle of the cable tag. The installer, therefore, can insert his or her finger between the two halves of the folded cable tag to pull the two sides apart. The tags comes off easily, and the adhesive is resilient enough to be reattached 2–5 times.

Figure 1:
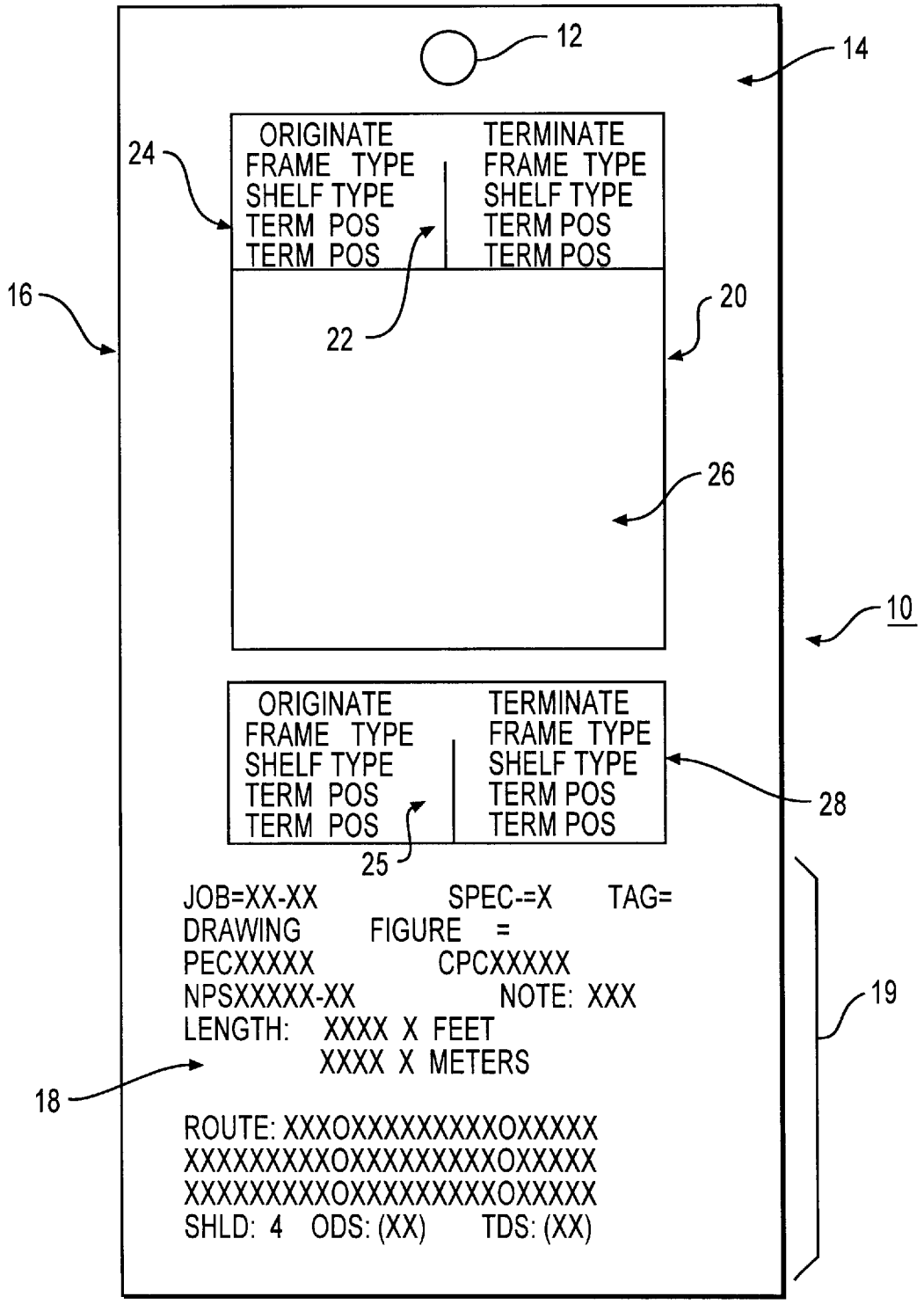
FIG. 1 is a front view of a single cable tag with two removable sub-labels in accordance with an embodiment of the present invention.

An exemplary embodiment of the cable tag of the present invention is shown in FIG. 1 and is designated generally by reference numeral 10. Cable tag 10 may preferably be constructed of face stock 14 on a liner 16, with an adhesive on the backside of face stock 14 and identifying information thermally printed on the top surface of the face stock. Preferably, such information is electronically transferred from purchasing to fabricating where it is then printed onto labels using thermal printers. The adhesive is preferably a permanent acrylic-based pressure sensitive adhesive, available from various sources. The face stock 14 is preferably Brady XB-427, which is a white clear vinyl film that has a topcoat specifically formulated for thermal transfer printing or its equivalent. The liner 16 is preferably 40# liner.

Cable tag 10 is generally rectangular in shape, but may take any geometric shape required for a particular application such as triangular, square, or circular. Each cable tag 10 has a hole 12 punched through the tag along the top edge to allow the tag to be adaptable to certain very specialized applications. Identifying information 18 used by cable fabricators is printed along the bottom portion 19 of the cable tag 10. Information 18 may be of any type, but preferably includes data concerning the length of the applied cable, a particular job and drawing number, and certain routing details.

A portion of the face stock 14 of cable tag 10 is die cut to form a first label 20 that can be removed from cable tag 10 and applied to a cable (not shown). First label 20 comprises an upper region of opaque face stock 22 on which information 26 is thermally printed for use by cable installers. Printed information 26 may include, for example, originating and terminating information of the cable for its installed configuration. First label 20 also has a lower region 26 of clear face stock. The surface area of the lower region 26 allows the first label 20 to be adhesively applied to cables with large diameters, in a manner described in more detail below.

A second portion of face stock 14 of cable tag 10 is die cut to form a second label 28 that can be removed from cable tag 10 and applied to a cable (not shown). Second label 28 comprises a portion of opaque face stock that preferably has a substantially rectangular shape but may have any geometric shape required for an application, such as triangular, square, or circular. The second label 28 includes information 25 printed on it. Information 25 may include, for example, originating and terminating information for the cable for use by cable installers. Second label 28 is generally smaller than first label 20 for application on cables having diameters smaller than cables for first label 20.

Figure 2:
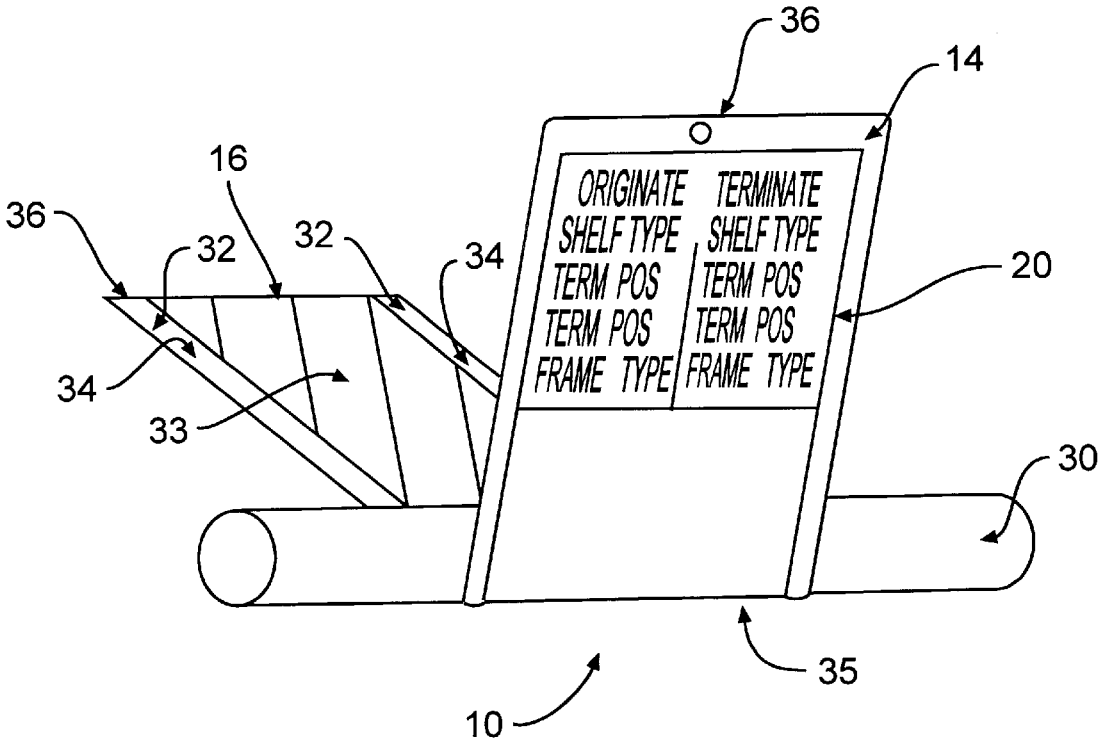
FIG. 2 is a view of the cable tag of FIG. 1 during application to a section of communications or power cable.

FIG. 2 illustrates the application of cable tag 10 to a communications or power cable 30. As discussed above, cable tag 10 may preferably be constructed of face stock 14 on a liner 16, with a strong adhesive positioned between face stock 14 and liner 16. To apply cable tag 10 to a cable, such as a communications or power cable, strips (not shown) are preferably peeled from each side of liner 16 to reveal areas 32. The removal of the strips leaves a portion 33 of liner 16 positioned between areas 32 that remains adhered to face stock 14. Exposed areas 32 reveal sections of adhesive 34. Cable tag 10 is then folded about an axis 35 and around cable 30 in such a way that, in a preferred embodiment, ends 36 of cable tag 10 will be approximately flush when brought together. The folding of cable tag 10 about axis 35 causes opposing backfaces of cable tag 10 in the sections of adhesive 34 to be brought together into contact. In this way, the exposed areas 32 need not be located as strips at opposing sides of the liner 33, as shown preferably in FIG. 2, but may be located at any position within the liner 33 such that the sections of adhesive 34 revealed by the removal of the strips will mate when cable tag 10 is folded about an axis such as 35. However, the exposed areas 32, when located as strips at the sides of the liner 33, protect the adhesive on the backside of first label 20 and second label 28, as shown in FIG. 1, which enhances the reliability of those labels when applied. As will be apparent to one of ordinary skill in the art, after the removal of strips of liner 33 to reveal areas 32, cable tag 10 may be wrapped around and adhered to a vast variety of longitudinal structures, particularly tubular communications cables or ribbon cables.

Figure 3:
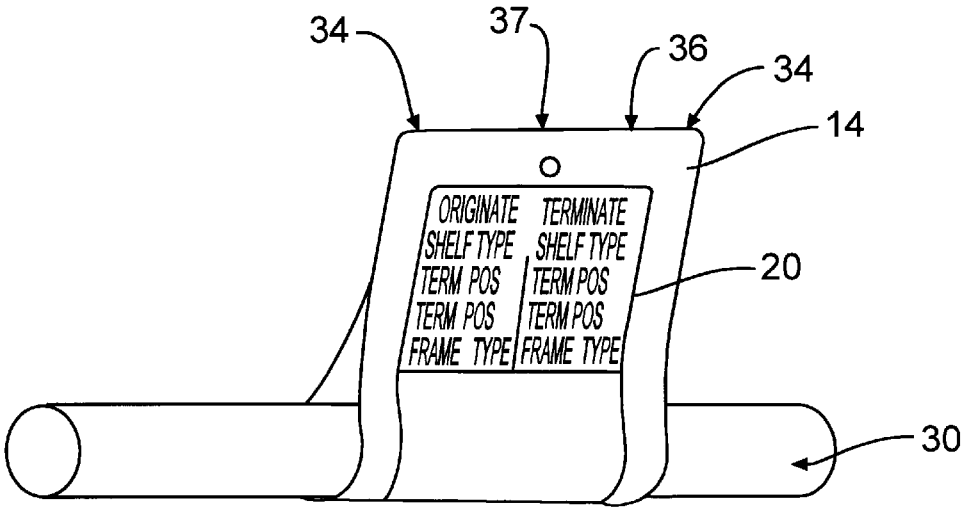
FIG. 3 is a view of the cable tag of FIG. 1 secured to a section of communications or power cable.

FIG. 3 shows cable tag 10 secured about a tubular cable 30. Ends 36 are shown flush, though such an arrangement is not required for practice of the present invention. The exposed strips of adhesive 34 contact each other along a portion of the side where the strips have been removed in areas 32, securing the cable tag 10 to the cable 30. However, the area 37 where liner 33 remains between adhesive strips 34 does not adhere to the opposite backside of liner 33 across axis 35 after cable tag 10 is folded. The exposed strips of adhesive 34 adhere both to the tubular cable 30 and to each other where they are brought together by folding. Area 37 allows the user to insert his/her fingers between the folded sides of cable tag 10 and pull the two sides apart to remove the cable tag 10 from tubular cable 30. Cable tag 10 can then be reattached between 2 and 5 times where, for example, the cable is shortened. Cable tag 10 may also be discarded to avoid clutter or a fire hazard. The size of cable tag 10, therefore, is not critical.

Figure 4:
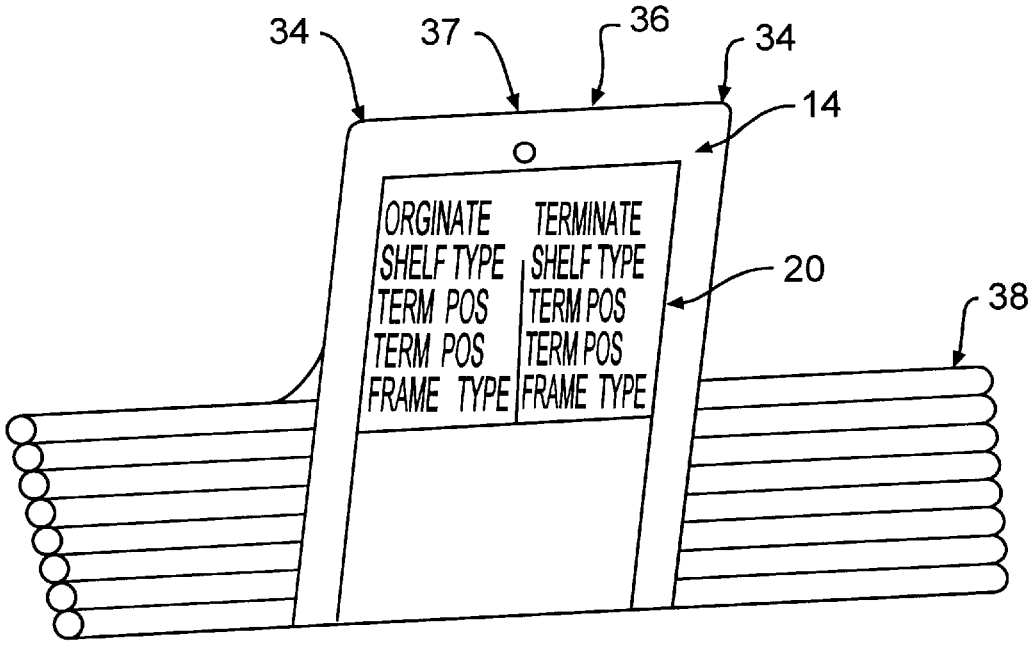
FIG. 4 is a view of the cable tag of FIG. 1 secured to a section of ribbon cable.

FIG. 4 shows cable 10 secured about a ribbon cable 38. As with cable 30, cable tag 10 is wrapped about ribbon cable 38 so that ends 36 are preferably brought approximately flush. The exposed strips of adhesive 34 contact each other along a portion of the side where the strips 32 have been removed, securing the cable tag 10 to the ribbon cable 38. However, the area 37 where liner 33 remains between adhesive strips 34 is freely separable. The exposed strips of adhesive 34 adhere both to the ribbon cable 38 and to each other where they are brought together by folding. Area 37 allows the user to insert his/her fingers between the folded sides of cable tag 10 and pull the two sides apart to remove the cable tag 10 from tubular cable 30.

As further noted above, another key feature of the present invention is the use of at least one preprinted sub-label, such as 20 or 28 in FIG. 1, that allows information about the cable and its routing to be transferred from the cable tag and be permanently affixed to the cable. Cable tag 10 of the present invention allows an installer to separate originating and terminating information, for example, from the rest of the tag at the end of the installation job. The sub-labels 20 and 28 are fashioned preferably to be made of the same face stock 14 as the remainder of the cable tag 10 and adhered to liner 33 using the same adhesive as used to adhere the remainder of the cable tag 10. The sub-labels 20 and 28 may preferably be achieved by printing the originating and terminating information on the original face stock 14 and then having face stock 14 of the cable tag 10 die cut around the originating and terminating information to create two sub-labels for different sized cables. These two sub-labels can then be removed by the installer and applied to the cable in the appropriate location at the end of the job. In the preferred embodiment, each cable tag has two different sized sub-labels to accommodate the range of possible cable diameters.

Figure 5:
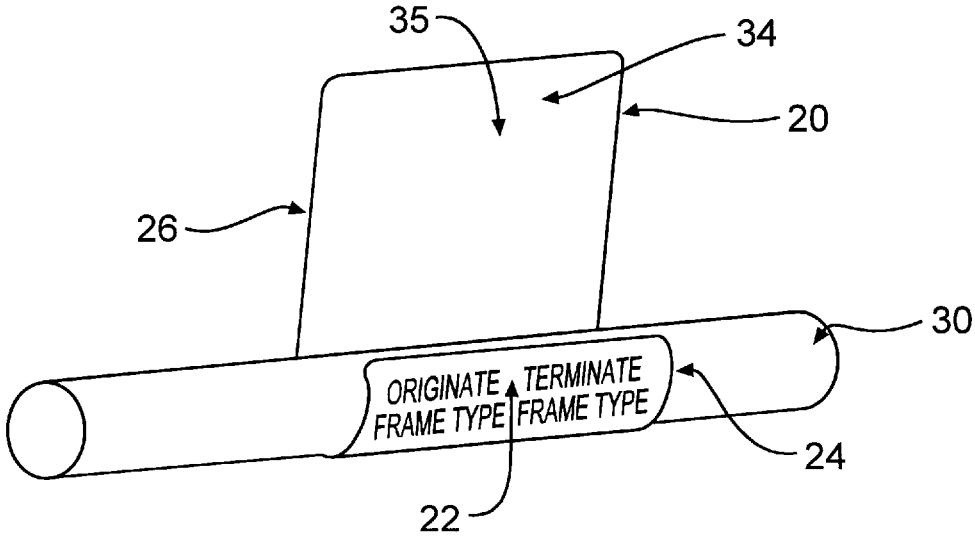
FIG. 5 is a view of a first sub-label from the cable tag of FIG. 1 being applied to a section of communications or power cable.

FIG. 5 shows first sub-label 20 being applied to cable 30, after it has been separated from the remainder of face stock 14, shown in, for example, FIG. 1. At the appropriate time in the installation process, first sub-label 20 is separated from the remainder of face stock 14. This removal exposes adhesive 34 on the side opposite the side of first sub-label 20 with thermally printed originating and terminating information 22. First sub-label 20 has an opaque region 24, which contains the printed information about the cable and its route, and a transparent region 26. After separation from liner 33, the first sub-label 20 may preferably be first brought into contact with cable 30 by contacting the adhesive area under the opaque region 24 to cable 30, thereby securing that end to cable 30. First sub-label 20 may then be wrapped around cable 30 in the direction indicated by 35. The transparent portion 26 of first sub-label 20 should have a length sufficient to wrap sub-label 20 completely around the circumference of cable 30. In a preferred embodiment, the transparent portion 26 has a length sufficient to cause transparent portion 26 to overlap opaque region 24. In a most preferred embodiment, transparent portion 26 has a length sufficient to cause it to wrap around and cover all of opaque region 24 when applied to a cable, which will provide further protection to the thermally printed originating and terminating information 22 from harsh environmental and installation conditions.

Figure 6:
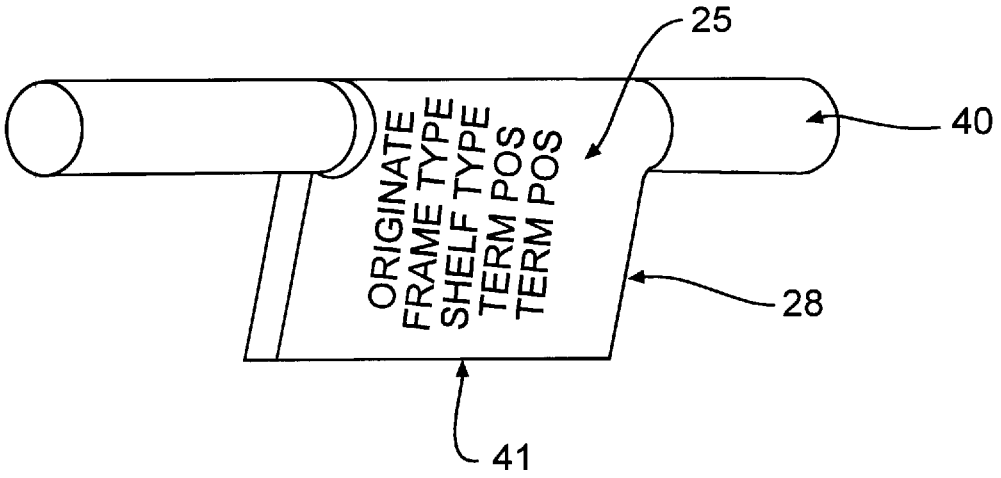
FIG. 6 is a view of a second sub-label from the cable tag of FIG. 1 during application to a section of communications or power cable having a small diameter.

FIG. 6 shows second sub-label 28, after it has been separated from the remainder of face stock 14 as shown in FIG. 1, applied to round cable 40. Cable 40 has a diameter smaller than the diameter of cable 30. The second sub-label 28 may be configured to have a smaller area than first sub-label 20. At the appropriate time in the installation process, second sub-label 28 is separated from the remainder of face stock 14. This removal exposes adhesive 34 on the side opposite the side of second sub-label 28 with thermally printed originating and terminating information 25. Second sub-label 28 is preferably then folded about smaller diameter round cable 40. Second sub-label 28 typically has a length compared with the circumference of cable 40 such that wrapping label 20 completely around cable 40 would likely cause some printed information on sub-label 28 to become overlapped and obscured. In contrast to the installation technique of first sub-label 20, the installation of second sub-label 28 preferably occurs by bringing the exposed opposing adhesive undersides together to secure the label to the smaller diameter round cable 40 so that the opposing edges 41 of the second label 28 are approximately flush with each other.

Figure 7:
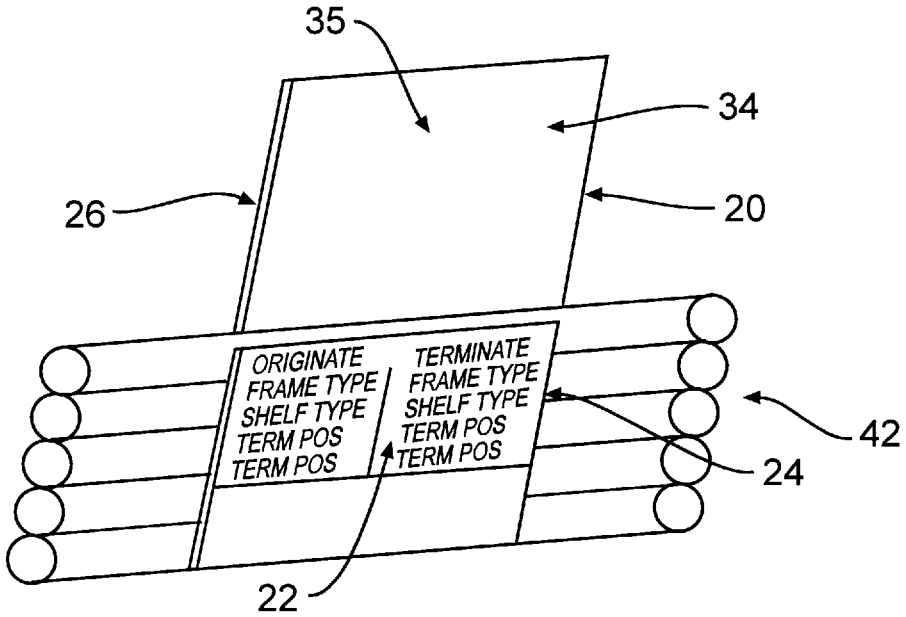
FIG. 7 is a view of the first sub-label from the cable tag of FIG. 1 during application to a section of ribbon cable.

In FIG. 7, first sub-label 20 is shown being applied to a wide ribbon cable 42, after it has been separated from the remainder of face stock 14 shown in FIG. 1. At the appropriate time in the installation process, first sub-label 20 is separated from the remainder of face stock 14. This removal exposes adhesive 34 on the side opposite the side of first sub-label 20 with thermally printed originating and terminating information 22. The adhesive area under the opaque region 24 of first sub-label 20 is first brought into contact with ribbon cable 42, securing that end to ribbon cable 42. First sub-label 20 is then wrapped around ribbon cable 42 in the direction indicated by 35. The transparent portion 26 of first sub-label 20 will cover all or part of the opaque region 24, providing further protection to the thermally printed originating and terminating information 22 from environmental and installation conditions.

Figure 8:
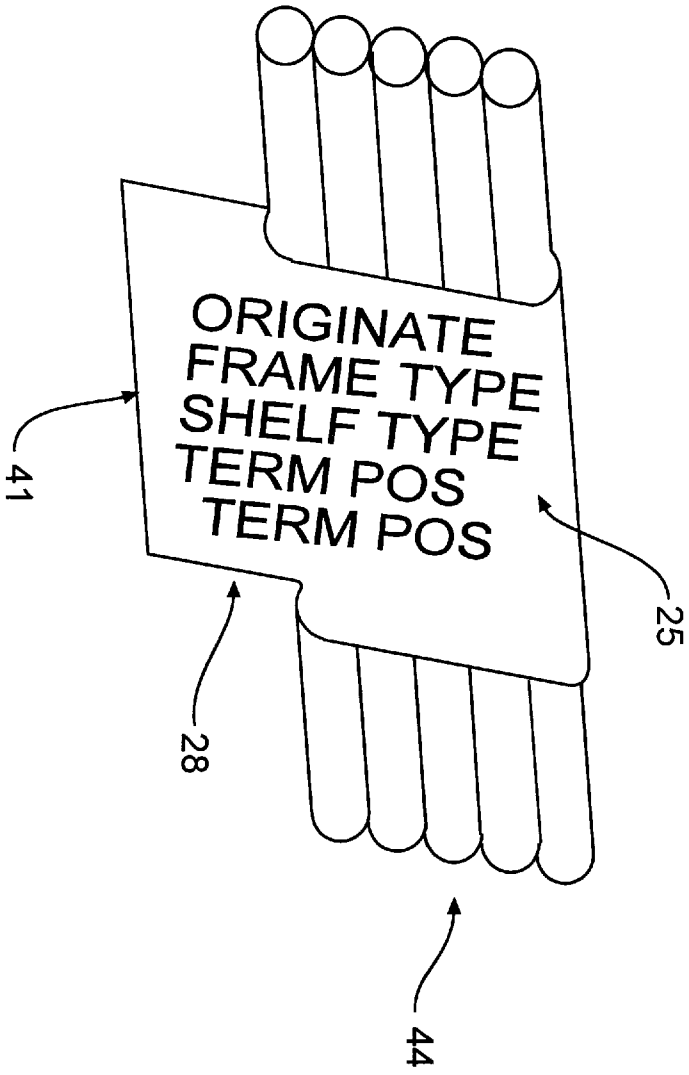
FIG. 8 is a view of the second sub-label from the cable tag of FIG. 1 during application to a section of ribbon cable having a small diameter.

FIG. 8 shows second sub-label 28 being applied to a ribbon cable 44 that has a width smaller than ribbon cable 42 shown in FIG. 7. This installation occurs after second sub-label 28 has been separated from the remainder of face stock 14 shown in FIG. 1. As with the previous installation steps described above, second sub-label 28 is separated from the remainder of face stock 14. This removal exposes adhesive 34 on the side opposite the side of second sub-label 28 with thermally printed originating and terminating information 25. Second sub-label 28 typically has a length compared with the circumference of cable 40 such that wrapping label 20 completely around cable 40 would likely cause some printed information on sub-label 28 to become overlapped and obscured. In contrast to the installation technique of first sub-label 20, second sub-label 28 is then folded about smaller width ribbon cable 44 and the exposed opposing adhesive undersides are brought together to secure the label to the smaller width ribbon cable 44 so that the opposing edges 41 of the second label 28 are approximately flush with each other.

In summary, the present invention comprises a tag for a cable, such as a communications or power cable, with a removable sub-label formed from a liner, adhesive, and face stock. Information is preferably printed on the face stock using a thermal printer. The user simply peels the sub-label from the tag, which is partially adhered to the cable during installation, and applies it to the cable for permanent cable identification.

The cable tag of the present invention allows the installer to apply a larger tag to the cable during installation. This larger tag utilizes strong adhesive, which holds the tag in place during installation. It, however, provides means for the installer to remove or reliably reposition the tag. Moreover, after the cable has been installed the installer simply peels the appropriate size sub-label off of the label and attaches the sub-label to the cable. The sub-label has the originating and terminating information preprinted on it. The installer can then easily remove the larger cable tag and dispose of it.

It will be apparent to those skilled in the art that various modifications can be made in the present invention without departing from the spirit or scope of the invention. Thus, it is intended that the present invention cover the modifications and variations of this invention provided they come within the scope of the appended claims and their equivalents.

What is claimed is:

1. A tag for indicating identifying and routing information on a cable, comprising:

a face stock having a first surface area containing identification and routing information about said cable and including a first separable sub-label within a portion of said first surface area, said first separable sub-label having an opaque surface area containing said identification and routing information and a transparent surface area and having a boundary for removably separating said sub-label from said first surface area;

an adhesive affixed to a back side of said face stock opposite said first surface area; and a liner removably affixed to said adhesive having a die-cut portion to form a separable section, said die-cut portion being symmetrical about a folding axis of said tag.

2. The tag of claim 1, wherein said adhesive is a permanent acrylic pressure sensitive adhesive.

3. The tag of claim 1, wherein said die-cut portion is located along opposing side edges of said tag.

4. The tag of claim 1, further comprising a second separable sub-label removable attached within a portion of said first surface area, said second separable sub-label containing said identification and routing information.

5. An apparatus for routing electromagnetic signals between at least two locations, comprising:

a cable; and at least one label having a length longer than a circumference of said cable, adhered to said cable, and wrapped at least partially around said cable such that at least portions of said label not contacting said cable contact each other, the label including:

a face stock having a first surface area containing identification and routing information about said cable and including a first separable sub-label within a portion of said first surface area, said first separable sub-label having an opaque surface area containing said identification and routing information and a transparent surface area and having a boundary for removably separating said sub-label from said first surface area;

an adhesive affixed to a back side of said face stock opposite said first surface area; and a liner affixed to said adhesive on said back side in all regions other than said at least portions of said label contacting each other.

6. The apparatus of claim 5, wherein said adhesive is a permanent acrylic pressure sensitive adhesive.

7. The apparatus of claim 5, wherein said liner is die cut along side edges of said tag to separate said liner from said face stock and to define said at least portions of said label contacting each other.

8. The apparatus of claim 5, further comprising a second separable sub-label removable attached within a portion of said first surface area, said second separable sub-label containing said identification and routing information.

9. The apparatus of claim 5, wherein said cable comprises a communications cable.

10. The apparatus of claim 5, wherein said cable comprises a ribbon cable.

11. A method of labeling an electromagnetic transmission cable with identifying and routing information, comprising the steps of:

removing a strip of liner material from a back side of a cable tag to expose a surface area of adhesive, the cable tag including face stock on a front side;

folding said cable tag about a horizontal axis defined by said cable to bring portions of said exposed surface area of adhesive into contact and to removably attach said cable tag to said cable along a remaining portion of said exposed surface area of adhesive, said cable tag including identification and routing information for the cable;

installing said cable in a facility;

removing a sub-label from the cable tag having an opaque surface area also containing said identification and routing information for the cable; and permanently affixing said sub-label to said cable by wrapping said sub-label about said cable.

12. The method of claim 11, further comprising the step of removing said cable tag from said cable.

13. The method of claim 11, wherein the removing sub-label step includes the substep of choosing an appropriately sized sub-label in accordance with a diameter of said cable from a plurality of sub-labels within said face stock.

14. The method of claim 11, wherein the folding step includes the substep of bringing said portions of said exposed surface area of adhesive into contact so that ends of said cable tag are substantially flush.

* * * * *

UNITED STATES PATENT AND TRADEMARK OFFICE

CERTIFICATE OF CORRECTION

PATENT NO. : 5,887,368

DATED : March 30, 1999

INVENTOR(S) : DIANA A. RUPP

It is certified that error appears in the above-identified patent and that said Letters Patent is hereby corrected as shown below:

IN THE CLAIMS:

Claim 4, col. 8, line 26, and claim 8, col. 8, line 58, change "removable" to --removably--.

Signed and Sealed this

Twenty-seventh Day of July, 1999

*Attest:*

Q. TODD DICKINSON

*Attesting Officer*

*Acting Commissioner of Patents and Trademarks*